US010414637B2

(12) United States Patent
Boos et al.

(10) Patent No.: US 10,414,637 B2
(45) Date of Patent: Sep. 17, 2019

(54) TELESCOPIC SECTION HAVING A VARIABLY EXTENDING FITTING EDGE

(71) Applicant: Liebherr-Werk Ehingen GmbH, Ehingen (DE)

(72) Inventors: Bernd Boos, Mehrstetten (DE); Holger Schilke, Ehingen (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 0 days.

(21) Appl. No.: 15/612,824

(22) Filed: Jun. 2, 2017

(65) Prior Publication Data

US 2017/0349414 A1 Dec. 7, 2017

(30) Foreign Application Priority Data

Jun. 3, 2016 (DE) ..... 20 2016 003 525 U
Aug. 17, 2016 (DE) ..... 20 2016 005 056 U

(51) Int. Cl.
*B66C 23/70* (2006.01)
*B66C 23/04* (2006.01)

(52) U.S. Cl.
CPC ..... *B66C 23/701* (2013.01); *B66C 23/04* (2013.01)

(58) Field of Classification Search
CPC ..... B66C 23/00; B66C 23/04; B66C 23/62; B66C 23/64; B66C 23/66; B66C 23/701; Y10T 29/49893; Y10T 29/49968; Y10T 29/49616; Y10T 29/49631; Y10T 29/49634
See application file for complete search history.

(56) References Cited

U.S. PATENT DOCUMENTS 2,772,790 A * 12/1956 Kauffman ..... B66C 23/66 212/177
3,355,034 A * 11/1967 Holan ..... B66C 23/701 212/177
3,789,869 A * 2/1974 Morris ..... B66C 23/64 137/351
4,112,649 A * 9/1978 Fritsch ..... B66C 23/701 52/118
4,171,598 A * 10/1979 Holmes ..... B66C 23/701 52/118
4,216,895 A * 8/1980 Holmes ..... B66C 23/42 228/166
4,459,786 A * 7/1984 Pitman ..... B66C 23/701 212/348
4,494,351 A * 1/1985 Thomasson ..... B66C 23/64 52/690
5,884,791 A * 3/1999 Vohdin ..... B66C 23/701 212/348
6,098,824 A * 8/2000 Krebs ..... B66C 23/701 212/347

(Continued)

FOREIGN PATENT DOCUMENTS

DE 1951445 B1 10/1970
FR 2071769 A5 9/1971

*Primary Examiner* — Michael R Mansen
*Assistant Examiner* — Juan J Campos, Jr.
(74) *Attorney, Agent, or Firm* — McCoy Russell LLP

(57) ABSTRACT

A boom section for the boom of a telescopic crane has a lower shell and an upper shell. The lower shell and the upper shell are welded to one another, and the weld seam extends between the lower shell and the upper shell angled in at least one region to at least one section edge of the boom section.

10 Claims, 8 Drawing Sheets

(56) References Cited

U.S. PATENT DOCUMENTS

| | | | | |
|---|---|---|---|---|
| 6,516,962 | B1 * | 2/2003 | Irsch | B66C 23/701 212/347 |
| 8,678,210 | B1 * | 3/2014 | Harrington | B66C 23/00 212/177 |
| 2003/0106871 | A1 * | 6/2003 | Paschke | B66C 23/701 212/347 |
| 2011/0068076 | A1 * | 3/2011 | Schmidt | B66C 23/64 212/276 |
| 2012/0199543 | A1 * | 8/2012 | Bell | B66C 23/64 212/299 |
| 2012/0199544 | A1 * | 8/2012 | Aus | B66C 23/64 212/299 |
| 2013/0020274 | A1 * | 1/2013 | Munuswamy | B66C 23/701 212/347 |
| 2013/0337285 | A1 * | 12/2013 | Gruber | B62D 21/11 428/595 |
| 2014/0083968 | A1 * | 3/2014 | Kobayashi | B66C 23/701 212/348 |

* cited by examiner

PRIOR ART

TELESCOPIC SECTION HAVING A VARIABLY EXTENDING FITTING EDGE

CROSS REFERENCE TO RELATED APPLICATIONS

This application claims priority to German Utility Model Application No. 20 2016 003 525, entitled "A Telescopic Section Having A Variably Extending Fitting Edge," filed Jun. 3, 2016, and further claims priority to German Utility Model Application No. 20 2016 005 056, filed on Aug. 17, 2016, the entire contents of each of which are hereby incorporated by reference in their entirety for all purposes.

TECHNICAL FIELD

The present disclosure relates to a boom section for the boom of a telescopic crane, having a lower shell and an upper shell, wherein the lower shell and the upper shell are welded to one another, and wherein the weld seam extends between the lower shell and the upper shell angled in at least one region to at least one section edge of the boom section.

BACKGROUND AND SUMMARY

Boom sections of telescopic cranes can comprise an upper shell and a lower shell that can be connected by means of a weld seam extending over the whole length of the section. These upper and lower shells can themselves already comprise a plurality of metal sheets, with fitting edges being able to extend both transversely and longitudinally with respect to the boom section. This type of construction is characterized in that the components of the upper shell and lower shell are produced from rectangular metal sheets and in that the connecting weld seam or the connecting weld seams of the upper and lower shells extend in parallel with the section edges of the boom section. This is related to the fact that non-planar regions of the boom section or of the upper shell and of the lower shell can be connected to one another with difficulty.

It is disadvantageous with the boom sections known from the prior art that the lower and upper shells welded to one another in parallel with their section edges have a constant lateral cross-section along the total length of the boom section or along a part of the boom section (e.g., only part of the boom section) while the load introduced into the boom section varies in dependence on the position at the boom section and on the force acting overall on the boom.

Known boom sections thereby have overdimensioned lateral cross-section portions in some regions while the same lateral cross-section portions can be underdimensioned in other regions of the boom section for correspondingly larger torques that occur there. It is known in a disadvantageous manner in this respect for the secure and stable design of the boom sections to design them such that the strength of the lower and upper shells is dimensioned to be sufficiently large along the total section length for the taking up of the largest torque occurring at the boom section. This has the result that a considerable overdimensioning of the boom section occurs in regions of the boom section having smaller loads introduced and thus an unnecessary large amount of material is installed and correspondingly excessive costs and weight arise in the manufacturing of corresponding boom sections.

Against this background, it is the object of the present disclosure to provide a boom section that is better adapted to the loads of different amounts that occur along the boom section and that can in this respect be manufactured with less use of material.

This object is achieved in accordance with the present disclosure by a boom section having a lower shell and an upper shell, wherein the lower shell and the upper shell are welded to one another, and wherein the weld seam extends between the lower shell and the upper shell angled in at least one region to at least one section edge of the boom section.

The angled extent of the weld seam in this respect means an extent that is not in parallel with the section edges. It is possible by the angled arrangement of the weld seam or of the weld seams between the lower shell and the upper shell to manufacture the lower shell and the upper shell of components that do not have any constant dimensions along the longitudinal axis of the boom section. A lower shell of optionally thicker design can thus, for example, take up a larger region of the cross-section of the boom section (referring to a lateral cross-section perpendicular to the longitudinal direction) in regions in which large loads act on the lower shell of the boom section, while the stronger or thicker lower shell can take up a smaller portion of the lateral cross-section of the boom section in regions of the boom section in which smaller loads act on the boom section or on its lower shell.

In these regions, in contrast, an upper shell that is thinner than the lower shell can take up a larger portion of the lateral cross-section of the boom section. A correspondingly obliquely extending weld seam or correspondingly obliquely extending weld seams thus enable boom sections to be manufactured with heterogeneous mechanical properties along the section length that are adapted to different load scenarios occurring along their longitudinal axes. The amount of material for providing a boom section having a defined stiffness can hereby be reduced. Conversely, the permissible payload of the corresponding telescopic boom can be increased with the same material use.

The term section edges can in this respect include all non-planar structures of the boom section, for example substantially longitudinally extending edges or correspondingly extending bending edges of the boom section. The boom section can in this respect have a polygonal and/or rounded lateral cross-sectional surface perpendicular to the longitudinal direction of the boom section. The external outlines of the lateral cross-sectional surface of the boom section can be polygonal and/or rounded, for example, due to the presence of the section edges between the planar portions of the boom section. In particular, where a cross-sectional view shows bent features, "section edges" may refer to areas where a bent structure meets a planar structure.

The "section edges" may be any edges of each of the upper shell and the lower shell. Section edges of the upper shell may be structurally integral with and formed from the same material as the remaining portions of the upper shell, and section edges of the lower shell may be structurally integral with and formed from the same material as the remainder of the lower shell.

The term weld seam is not related in the present case in a restrictive manner to a single weld seam between the lower shell and the upper shell; a plurality of weld seams, e.g. two weld seams, can also be present. They can be arranged at oppositely disposed sides of the boom section and can in particular extend symmetrically to one another. In other examples, there may be three, four, five, or more weld seams between the lower shell and the upper shell.

It is conceivable in an embodiment of the present disclosure that the lower shell has a greater thickness than the upper shell. Higher compression forces occurring at the thicker lower shell or bending torques that vary along the length of the boom section can thus advantageously be taken up by the lower shell without the lower shell in this respect being overdimensioned in portions for the correspondingly occurring loads and without thereby an overdimensioned boom section being present overall.

It is furthermore conceivable in a further embodiment that the lower shell rises in accordance with the torque progression (e.g., torque path) in the boom section. The rising of the lower shell in this respect means that it adopts a larger cross-sectional portion of the lateral cross-section of the boom section from bottom to top on an observation of the boom section from the side. If, for example, a linear increase of the load or of the introduced torque occurs at the boom section in question, the weld seam can rise in a correspondingly linear manner along the boom section.

It is conceivable in a further embodiment that the weld seam between the lower shell and the upper shell extends along the whole boom section (e.g., along the entire length of the boom section in the longitudinal direction) at a constant angle or at a varying angle to the section edges of the boom section and/or in a curved manner. The constant angle may be an angle greater than 0 degrees (e.g., such that the weld seam is not parallel to the section edge(s). Similar, each variation of the varying angle may be greater than 0 degrees. It is alternatively also conceivable that the weld seam between the lower shell and the upper shell extends along a part of the length of the boom section at a constant angle greater than 0 degrees or at a varying angle greater than 0 degrees to the section edges of the boom section and/or in a curved manner. The weld seam between the lower shell and the upper shell can extend in parallel with the section edges of the boom section along a different part or different parts of the boom section. Freely or approximately freely extending weld seam extents are also conceivable that make it possible to respond in a simple construction manner to structures such as bolting elements or other load introductions at the boom section. Mounts for these structures can be configured as reinforced by means of a lower shell that has larger dimensions and/or that takes up a larger part of the lateral cross-section of the boom section. The edges of the lower shell and of the upper shell are produced such that they correspond to one another or can be welded to one another without gaps when placed next to one another. For this purpose, an edge of a lower shell can be formed as a negative of the edge of an upper shell welded to it. This applies equally to weld seams that extend in angled form and in parallel and/or curved with respect to the section edges of the boom section.

It is furthermore conceivable in an embodiment that the lower shell and the upper shell are welded to one another in a laser hybrid process. Such methods make it possible to establish weld seams not extending in a planar manner simply, whereby welding can take place correspondingly over bending edges of the boom section extending longitudinally or at an angle. Alternatively or additionally, other welding processes are also conceivable by means of which a corresponding non-planar weld seam can be manufactured automatically.

The present disclosure furthermore relates to a boom for a telescopic crane having at least one of the boom sections described herein, as well as to a telescopic crane having at least one of the boom sections described herein.

Further details and advantages of the present disclosure are shown with reference to exemplary embodiments shown in the Figures.

DETAILED DESCRIPTION

Figure 1:
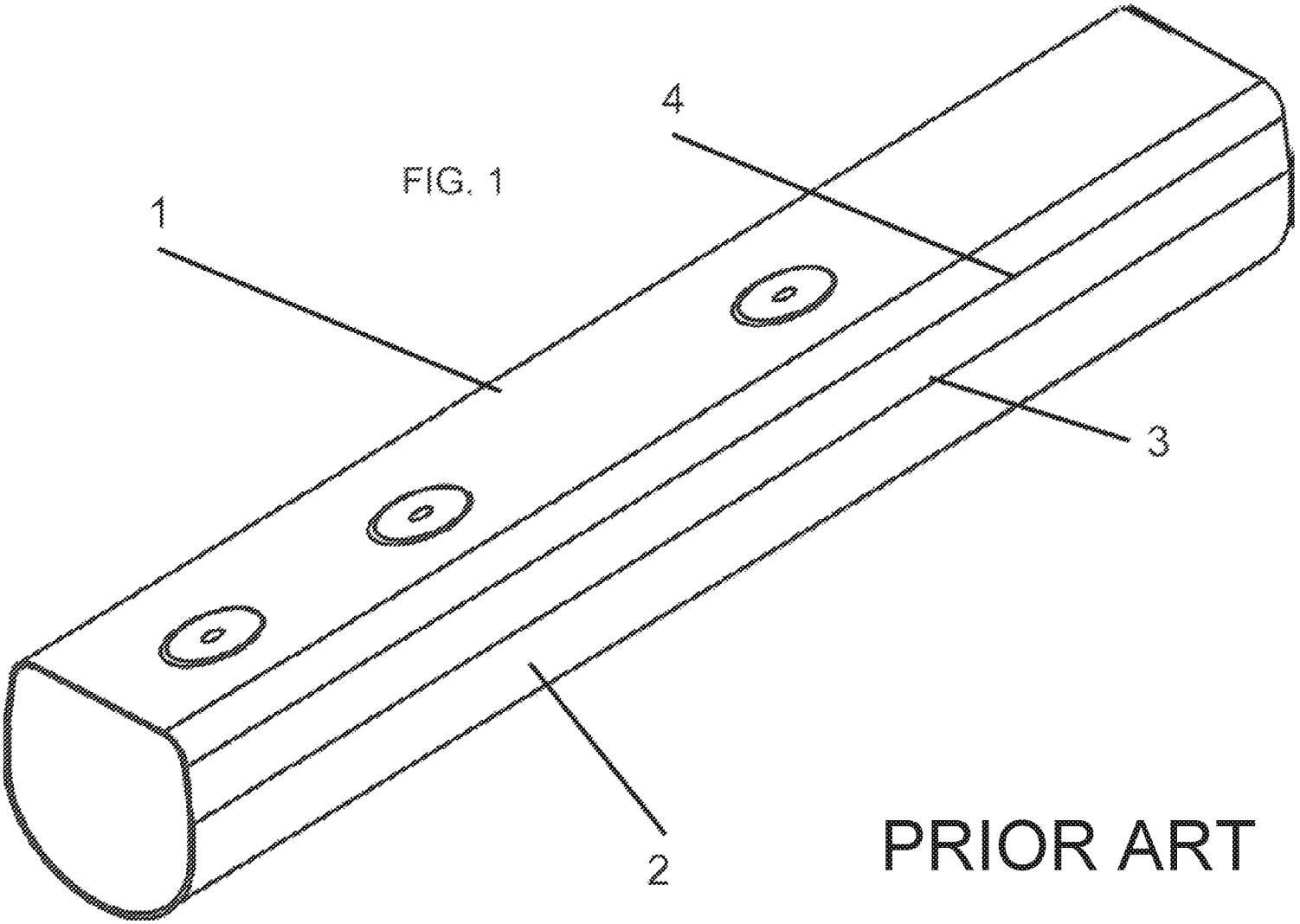
FIG. 1 PRIOR ART
FIGS. 1, and 2 show different views of a boom section in accordance with the prior art.
Figure 2:
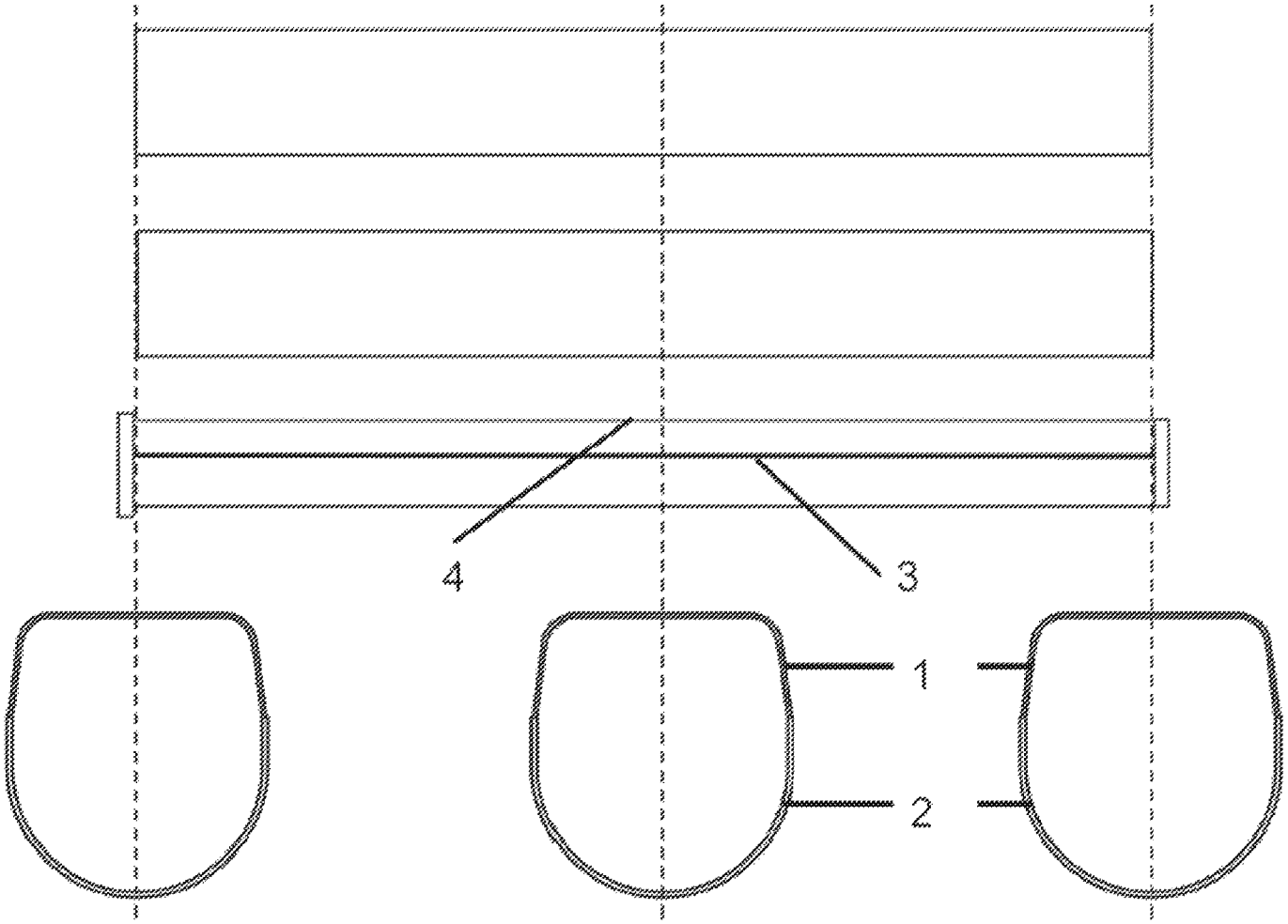

FIG. 1 shows a boom section of the boom of a telescopic crane known from the prior art having a lower shell 2 and an upper shell 1, wherein the lower shell 2 and the upper shell 1 are welded to one another by means of a weld seam 3 extending over the total section length. As can be recognized in FIGS. 1 and 2, the weld seam 3 extends in parallel with a section edge 4 of the boom section.

Figure 3:
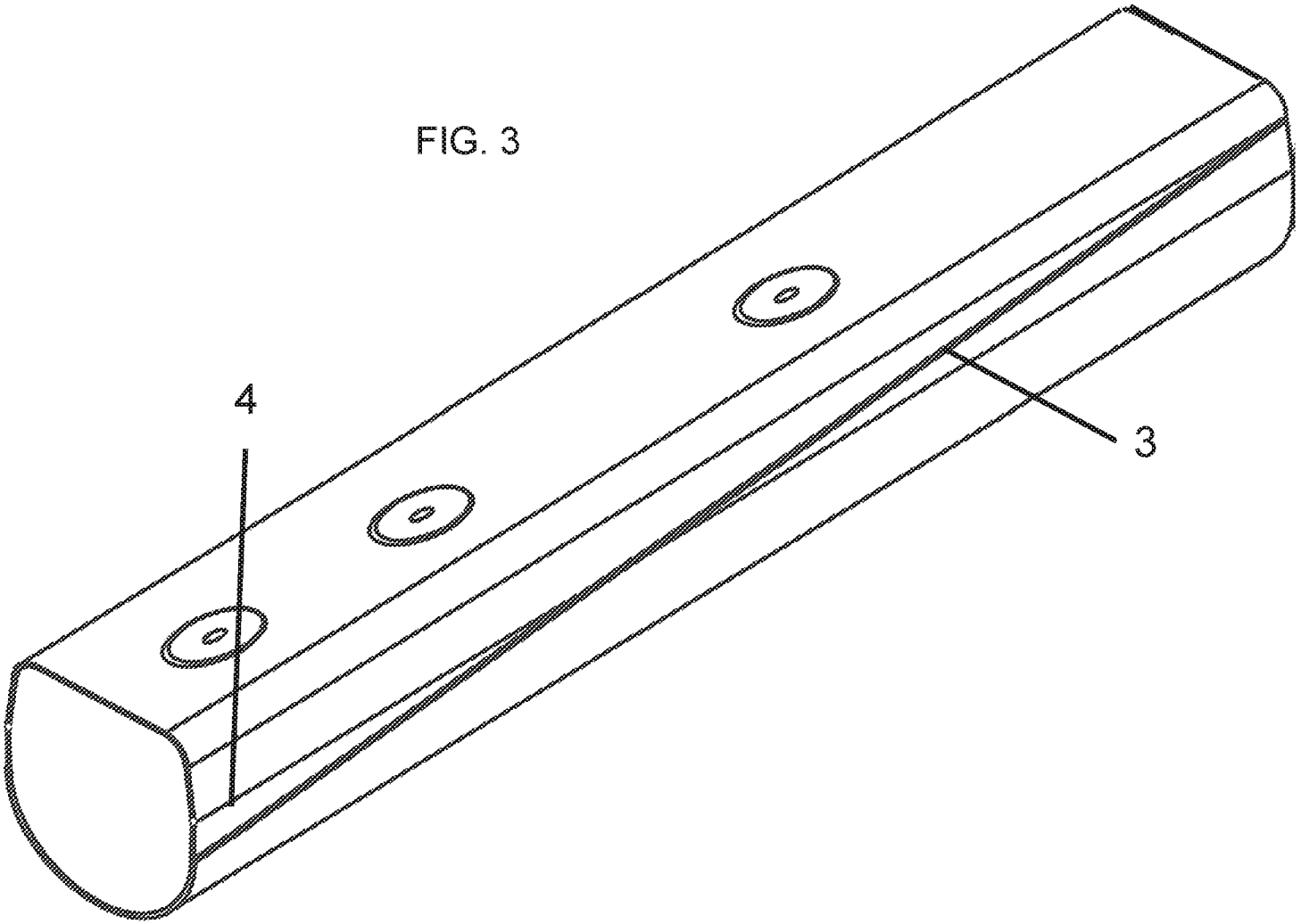
FIGS. 3, and 4 show different views of the boom section in accordance with the present disclosure with a weld seam rising over the total section length.
Figure 4:
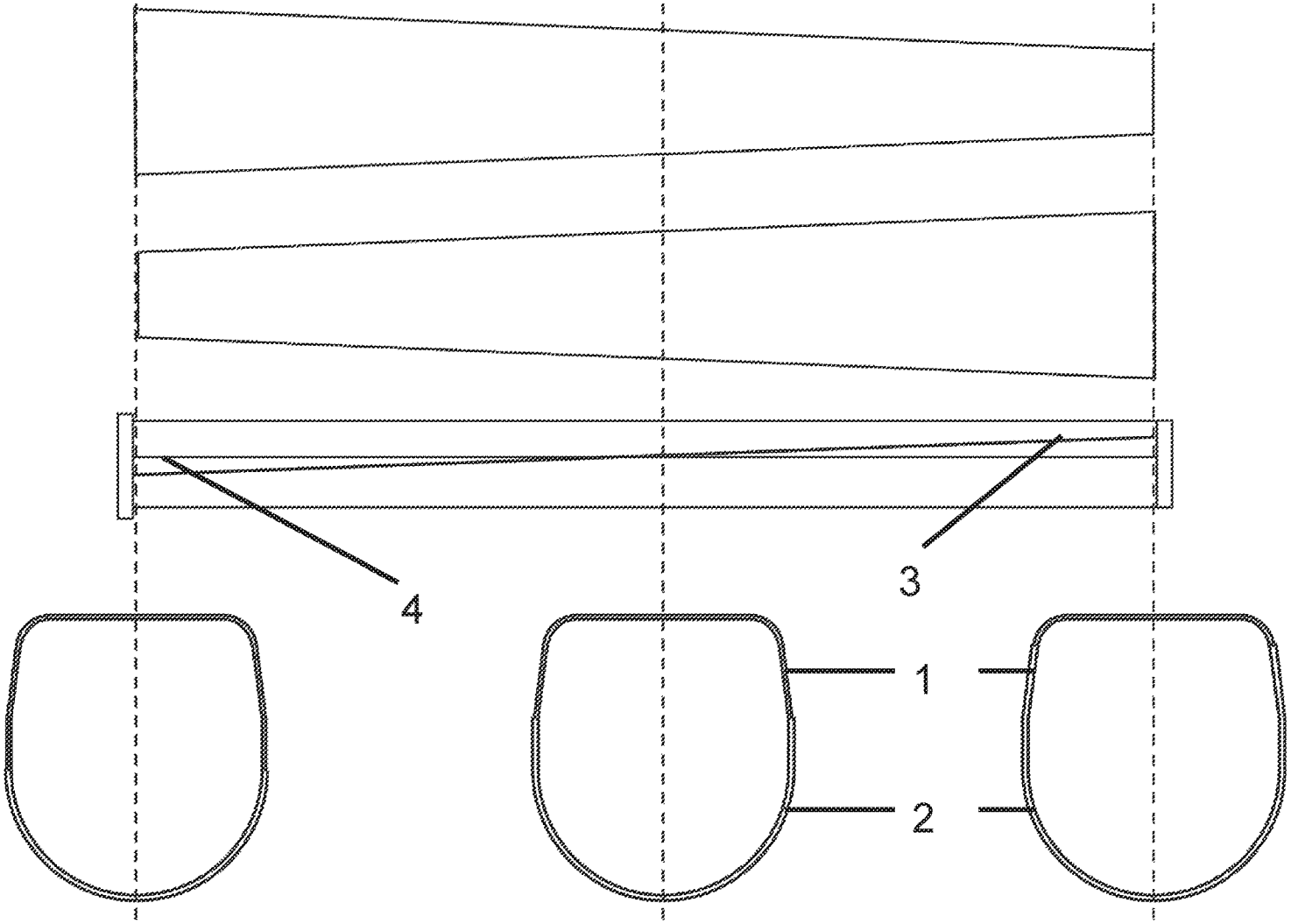

FIGS. 3 and 4 show a weld seam 3 in accordance with the present disclosure extending at an angle that can have a constant angle with the section edge 4 or with the second edges 4 over the total length of the boom section. The weld seam 3 extending at an angle can be called a fitting edge in this respect.

Figure 5:
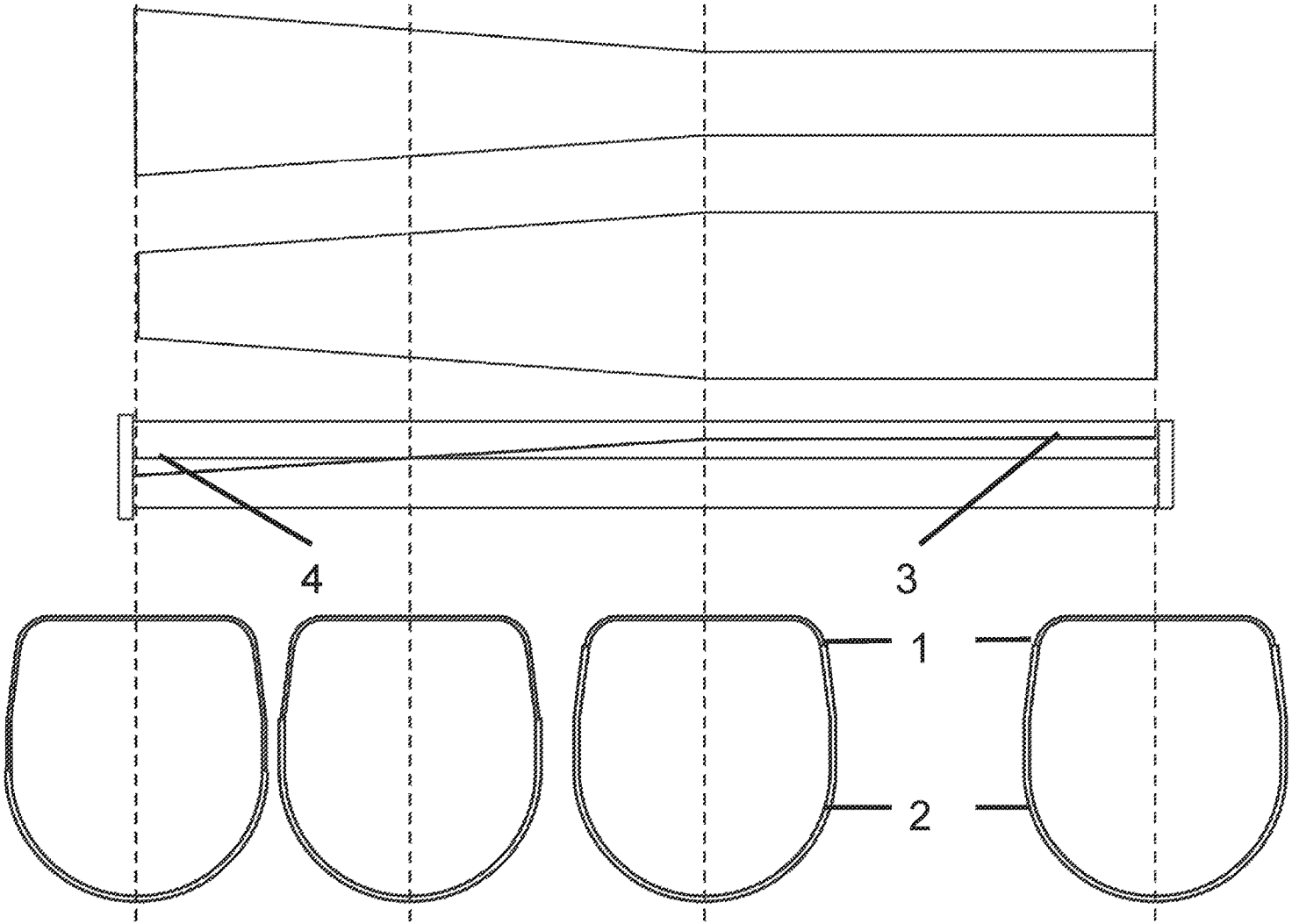
FIGS. 5, and 6 show different views of boom sections in accordance with the present disclosure with kinked weld seams.
Figure 6:
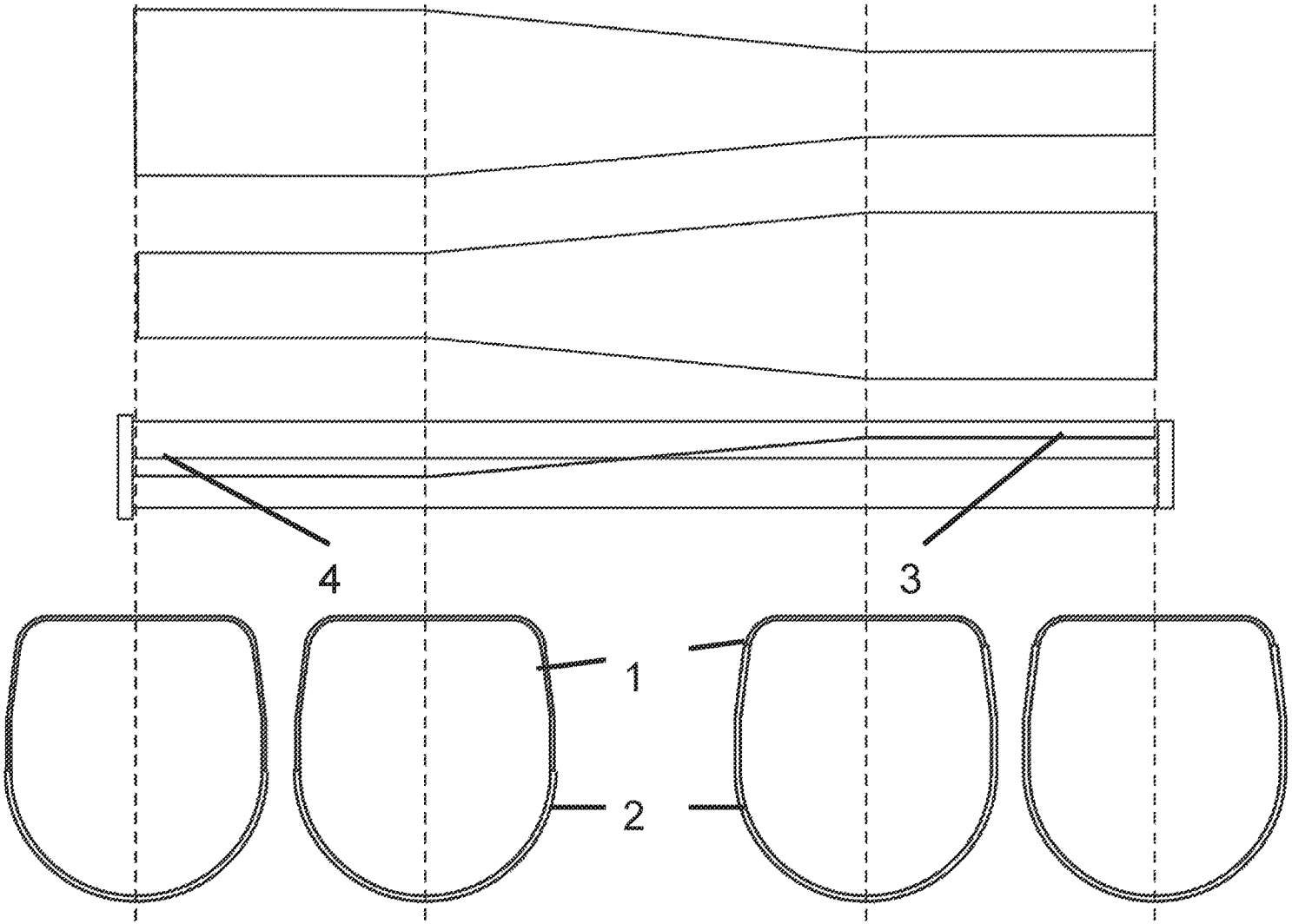

The welding beyond section edges 4 shown in FIGS. 3 to 7 or the welding of non-planar weld seams is possible by modern welding processes such as laser hybrid processes. The weld seam 3 can in this respect no longer extend in parallel with the section edges 4 and can instead extend at curved surfaces of the boom section and/or beyond edges. The optionally thicker lower shell 2 of the telescopic section or of the boom section can increase (e.g., the cross-sectional extent of the lower shell can increase relative to the cross-sectional extent of the upper shell) in accordance with the torque progression, such that a ratio of the lateral extent of the cross-section of the lower shell to the lateral extent of the cross-section of the upper shell at a given position along the length of the boom section is proportional to and/or varies with the compression force on the boom section and/or bending torque of the boom section at that position (e.g., when the boom section is subject to a load). A manner of construction is, however, also conceivable having an initially increasing or angled section extent or weld seam extent and having a parallel alignment of the weld seam 3 with section edges 4 of the boom section in the further extent, as is shown in FIG. 5. In the rear region of the boom section or in the right region of the boom section in FIG. 5, the further extent having the parallel alignment can be the clamping region of the boom section in which the boom section is clamped correspondingly in a different boom section or in another clamping apparatus.

Exemplary section edges 4*a* and 4*b* are identified in the rightmost cross-sectional views of FIG. 5. Section edge 4*a* is a longitudinally extending region of the upper shell where a bent portion of the upper shell meets a planar portion of the upper shell, and corresponds to the section edge labeled 4 in the side view shown in FIG. 5. Section edge 4*b* is a longitudinally extending region of the lower shell where a bent portion of the lower shell meets a planar portion of lower shell. Section edge 4*a* is structurally integrated in and forms part of the upper shell, and section edge 4*b* is structurally integrated in and forms part of the lower shell.

FIGS. 2 and 4-8 show different weld seam types in more detailed views. In this respect, the respective corresponding metal sheets of lower shell 2 and upper shell 1 are shown in unwound form in the upper region of the named Figures. In this respect, the lower shell 2 and the upper shell 1 are shown in a respective planar plan view and without the longitudinally extending section edges, that is unwound, required for completing the lower shell 2 and the upper shell 1.

Side views of the respective boom sections are shown in the middle regions of the named Figures, with additional terminations being able to be recognized at the ends of the boom sections.

Sectional views at the corresponding points of the boom sections are illustrated in the lower regions of the named Figures. It can be recognized in this respect that the lower shells 2 are as a rule thicker than the corresponding upper shells 1. Thicker can in this respect mean the sheet metal thickness of the corresponding component (e.g., the material forming the lower shell is thicker than the material forming the upper shell). The dashed vertical lines indicate the region in which the respective sections are arranged or which region of the corresponding boom section they show.

The sectional views show embodiments of the boom sections in which the lower shells 2 have a rounded lateral cross-section. All other lateral cross-sections are, however, conceivable that satisfy the demands of the corresponding telescopic crane.

The boom sections in accordance with the present disclosure can be manufactured such that a determination of which loads occur along the boom section is made in a first step. Which section thicknesses or material thicknesses are required to take up these loads along the longitudinal extent of the boom section is determined in a next step. In a next step, the geometry of lower and upper shells 2, 1 suitable for taking up the calculated loads is determined and the lower shells 2 and upper shells 1 thus defined are produced from suitable semi-finished products. The welding of the lower shell 2 and of the upper shell 1 takes place in a further step, e.g. by means of a laser hybrid process. Additional steps, e.g. for preparation or post-processing of the boom sections, or also further intermediate steps between the above-named main steps can naturally likewise be present.

Figure 7:
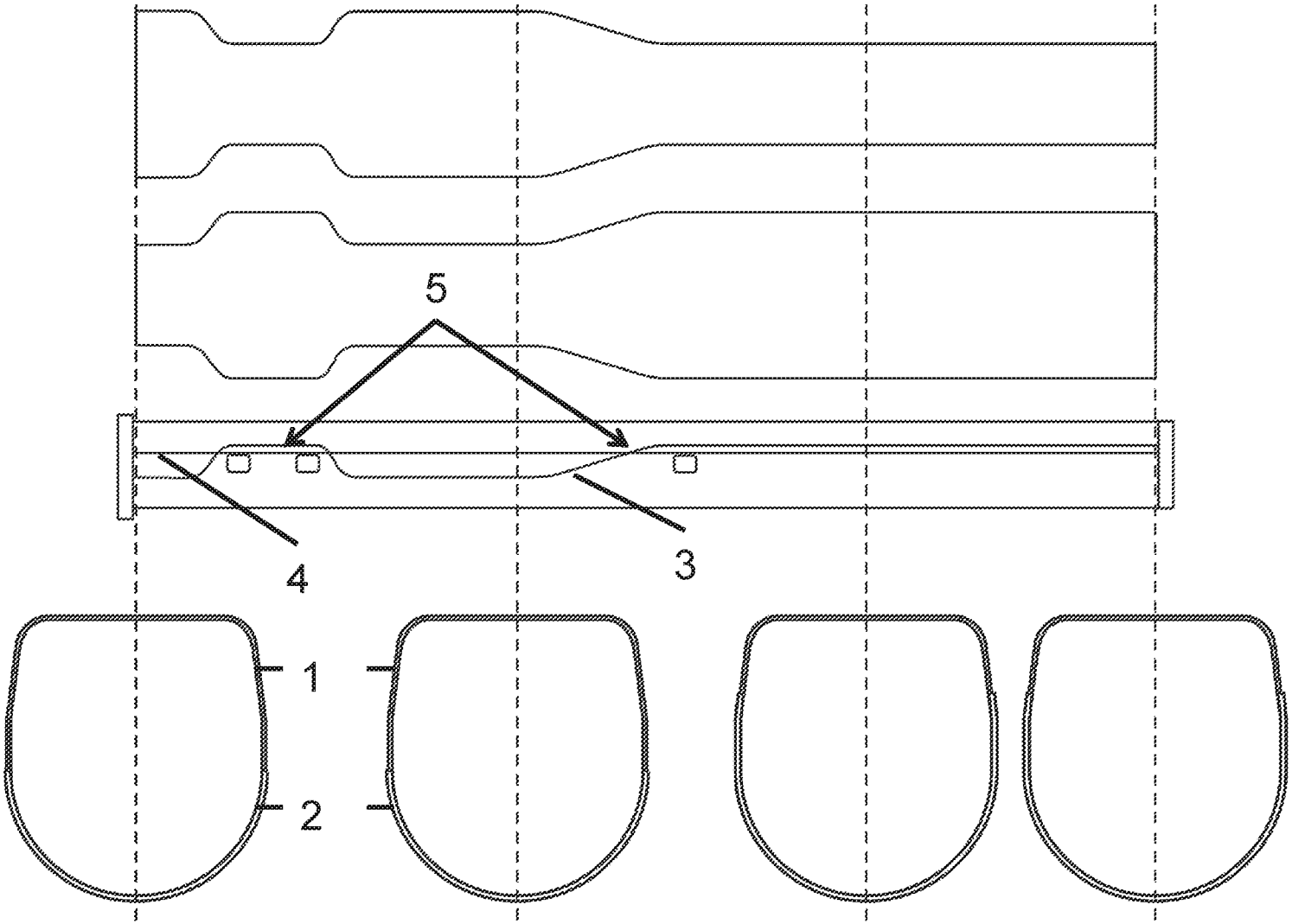
FIG. 7 shows different views of the boom section in accordance with the present disclosure with a freely extending weld seam.

FIG. 7 shows a weld seam 3 having a free extent in which regions 5 that are thicker than the remaining regions of the boom section, due to a corresponding weld seam course, can be formed by a correspondingly reinforced lower shell 2 that forms the regions 5 or that is arranged in the regions 5. The regions 5 to be thick can, for example, be portions at which force introductions into the boom section take place. Exemplary force introduction elements 9 arranged in regions 5 are shown. Force introduction elements 9 may be any structures which allow for the introduction of forces into the boom, such as welded plates or hardpoints in general.

Figure 8:
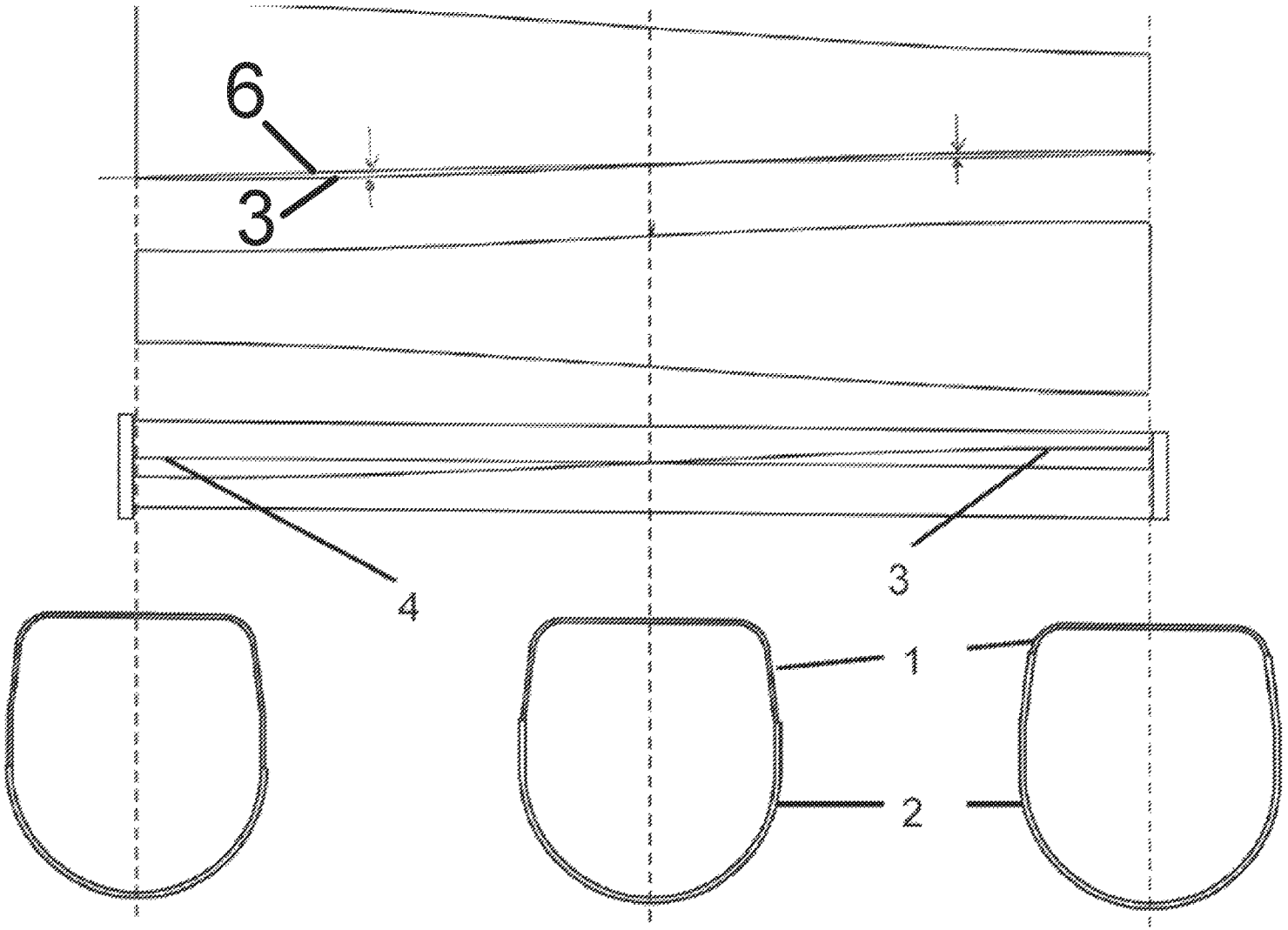
FIG. 8 shows different views of the boom section in accordance with the present disclosure with a weld seam extending in a curved manner.

FIG. 8 shows, in a similar manner to FIGS. 3 and 4, a weld seam 3 that extends at an angle in accordance with the present disclosure and that does not extend linearly over the total length of the boom section, but rather is at least partly curved. To better illustrate the curvature of the weld seam 3, a straight line 6 is shown and the spacing between the straight line 6 and the weld seam 3 is emphasized at specific points by two respective arrows directed against one another. The weld seams 3 of all the embodiments shown can be provided laterally at the boom sections, with a respective weld seam 3 typically being able to be provided at the left and right of the boom section (e.g., the left and right in a cross-sectional view of the boom section). The two weld seams 3 of a boom section can in this respect be symmetrical or non-symmetrical with respect to one another (e.g., a weld seam on the left side of the boom section in a cross-sectional view of the boom section may differ from a weld seam on the right side of the boom section).

An example includes a telescopic crane, which may be a mobile crane, comprising a telescopic boom which is rotatably hinged to the vehicle about an upright axis of rotation and is luffably hinged about a horizontal axis. The telescopic crane is one non-limiting embodiment of a telescopic crane which can incorporate one or more boom sections such as those described in the present disclosure.

In the example, the telescopic boom has a hinged boom section, which is hinged to the vehicle in the named manner, as well as two further telescopic boom sections which can be telescoped out of the hinged boom section. A guying of the telescopic boom is guided over a pair of guy supports. Guying-ropes lead from the free end of the guy supports to the tip of the telescopic boom, with it also being possible to guide the guy-ropes at the head of the central telescopic section, for example. The guy supports are in turn captured via guy-ropes in the region of the hinge end of the hinged section. The guy supports are movably hinged to the head of the hinged section, and indeed such that they are folded in a transport position at the hinged section, whereas they are spread apart in V shape in the manner shown in an operating position.

While the example including a telescopic crane includes exactly one hinged boom section and exactly two telescopic boom sections, it will be appreciated that a telescopic crane in accordance with the present disclosure may include a different number (e.g., one, three, four, etc.) of telescopic boom sections. Further, a telescopic crane in accordance with the present disclosure may be configured without a hinged boom section.

The invention claimed is:

1. A boom section for a boom of a telescopic crane, the boom section having a lower shell and an upper shell, wherein the lower shell and the upper shell are welded to one another, wherein a cross-sectional extent of the lower shell varies relative to a cross-sectional extent of the upper shell along a length of the boom section, and wherein a weld seam between the lower shell and the upper shell extends at least in one region of the boom section at an angle to at least one section edge of the boom section.

2. The boom section in accordance with claim 1, wherein the lower shell is thicker than the upper shell.

3. The boom section in accordance with claim 1, wherein the weld seam between the lower shell and the upper shell extends along an entirety of the boom section at a varying angle greater than 0 degrees to the at least one section edge of the boom section.

4. The boom section in accordance with claim 1, wherein the weld seam between the lower shell and the upper shell extends along a first part of the boom section at a varying angle greater than 0 degrees to the at least one section edge of the boom section.

5. The boom section in accordance with claim 4, wherein the weld seam between the lower shell and the upper shell extends along a second part of the boom section in parallel with the at least one section edge of the boom section, and wherein the first and second parts of the boom section are contiguous.

6. The boom section in accordance with claim 1, wherein the weld seam is curved and extends along an entire length of the boom section.

7. The boom section in accordance with claim 1, wherein the weld seam is curved and extends along only part of a length of the boom section.

8. A boom for a telescopic crane having at least one boom section, the boom section having a lower shell and an upper shell, wherein the lower shell and the upper shell are welded to one another, wherein a cross-sectional extent of the lower shell varies relative to a cross-sectional extent of the upper shell along a length of the boom section, and wherein a weld seam between the lower shell and the upper shell extends at least in one region of the boom section at an angle greater than 0 degrees to at least one section edge of the boom section.

9. A telescopic crane having at least one boom section, the boom section having a lower shell and an upper shell, wherein the lower shell and the upper shell are welded to one another, wherein a cross-sectional extent of the lower shell varies relative to a cross-sectional extent of the upper shell along a length of the boom section, and wherein a weld seam between the lower shell and the upper shell extends at least in one region of the boom section at an angle greater than 0 degrees to at least one section edge of the boom section.

10. A boom section for a boom of a telescopic crane, the boom section having a lower shell and an upper shell, wherein the lower shell and the upper shell are welded to one another, wherein a cross-sectional extent of the lower shell varies relative to a cross-sectional extent of the upper shell along a length of the boom section, and wherein a weld seam between the lower shell and the upper shell extends at least in one region of the boom section at an angle to at least one section edge of the boom section and wherein the telescopic crane is a mobile crane.

* * * * *